US006866022B1

(12) United States Patent
Phillips et al.

(10) Patent No.: US 6,866,022 B1
(45) Date of Patent: Mar. 15, 2005

(54) THROTTLE CONTROL HANDLE WITH REDUCED REQUIRED SHIFTING FORCE

(75) Inventors: George E. Phillips, Oshkosh, WI (US); Wayne M. Jaszewski, Jackson, WI (US); Gregory L. Fugar, Oshkosh, WI (US); John M. Griffiths, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 19 days.

(21) Appl. No.: 10/654,297

(22) Filed: Sep. 3, 2003

(51) Int. Cl.[7] ..... F02D 9/00
(52) U.S. Cl. ..... 123/400; 74/480 B
(58) Field of Search ..... 123/400; 74/480 B, 74/482

(56) References Cited

U.S. PATENT DOCUMENTS 4,253,349 A 3/1981 Floeter et al. ..... 74/878
4,632,232 A 12/1986 Kolb et al. ..... 192/0.096
4,794,820 A 1/1989 Floeter ..... 74/878
4,850,318 A * 7/1989 Torigai et al. ..... 123/400
5,188,206 A * 2/1993 Prince ..... 74/480 B
5,665,025 A * 9/1997 Katoh ..... 74/480 B
6,047,609 A 4/2000 Brower et al. ..... 74/473
6,050,866 A * 4/2000 Bass ..... 74/480 B

* cited by examiner

*Primary Examiner*—Erick Solis
(74) *Attorney, Agent, or Firm*—William D. Lanyi

(57) ABSTRACT

A remote control manually movable handle for a gear selection and throttle selection device is provided with asymmetry in order to improve the mechanical advantage available to the operator when moving the selection handle from neutral gear position to forward or reverse gear position. The total neutral zone is increased in order to provide this improved mechanical advantage while maintaining the generally similar range of travel of the forward gear zone in comparison to known prior art systems. By changing the relative gear teeth arrangements of the remote control system, this asymmetry and resulting mechanical advantage is achieved. A handle shape is provided that results in a general perpendicularity between the handle and a reference line in order to improve the feel of the handle when used by the operator of the marine vessel.

20 Claims, 6 Drawing Sheets

THROTTLE CONTROL HANDLE WITH REDUCED REQUIRED SHIFTING FORCE

BACKGROUND OF THE INVENTION

1. Field of the Invention

The present invention is generally related to a remote control throttle and shift handle for a marine vessel and, more particularly, to a throttle control handle that reduces the required shifting force that must be exerted by the operator of the marine vessel when shifting from neutral into forward or reverse gear positions.

2. Description of the Prior Art

Many different types of remote throttle control devices are well known to those skilled in the art. A remote control throttle device is one that is typically located near a helm position and which allows the operator of a marine vessel to shift between neutral gear position and either forward or reverse positions while being located at a distance remote from the actual marine propulsion device, such as an outboard motor. Typically, movement of a manually controllable handle causes push-pull cables to move and, as a result, changes a gear selector that is located at the outboard motor. Most throttle control mechanisms allow the operator of the marine vessel to select both gear position and throttle position.

U.S. Pat. No. 4,632,232, which issued to Kolb et al on Dec. 30, 1986, describes a single lever remote control throttle dwell and friction mechanism. The control mechanism is intended for operating the clutch and throttle of a marine motor and has a support on which a sleeve is mounted on a pivot. A rod is mounted in the sleeve for axial movement. The distal end of the rod is actuated to move the rod and the sleeve about the pivot and also to move the rod axially relative to the sleeve. An actuating arm and a cam track cooperate to move the rod and sleeve in an arc above the pivot between first and second positions between which the clutch is operated by an operator actuated by rotation of the arm about its pivot. The actuating arm moves the rod axially relative to the sleeve when the arm is beyond the clutch operating range. The rod is connected to the throttle. A friction device acts on the rod to resist axial movement of the rod relative to the sleeve. The friction load resists change of the throttle setting but has no effect on clutch operation.

U.S. Pat. No. 6,047,609, which issued to Brower et al on Apr. 11, 2000, discloses a remote control mechanism. The mechanism is provided with a cam mechanism that allows an operator of a marine vessel or other type of apparatus to move a handle along a generally linear path to simultaneously select the gear selection and throttle selection for the marine vessel. Cam mechanism within a support structure translate the linear motion of the handle into preselected motions that cause first and second actuators to affect first and second parameters is of the propulsion system. Cam followers attached to a control member are moved in coordination with the handle movement to cause first and second cam tracks to rotate about pivot points relative to the support structure. This rotation of the first and second cam tracks causes first and second actuators to be moved. The actuators, which can be cables, are also connected to selectors of both gear position and throttle position.

U.S. Pat. No. 4,253,349, which issued to Floeter et al on Mar. 3, 1981, discloses a control unit for marine engines employing neutral lock mechanisms. The control unit is intended for use with an engine of the type having a shift means for shifting between forward, neutral, and reverse and a throttle means for controlling engine speeds between idle and high speed including a housing and a control handle rotatably supported at one end of the housing. Shift and throttle cables extend between the engine and the housing and respond to rotation of the handle to control the engine shifting and throttle during portions of the period of the rotation of the handle. A lock rod extends through the handle and is adapted at one end to alternately engage and disengage with the housing; and when engaged with the housing, prevents rotation of the handle from a position corresponding to neutral and idle throttle. A trigger at the outer end of the handle is connected to axially rotate the lock rod to radially disengage the other end of the lock rod and to permit rotation of the handle out of the neutral and idle conditions. The lock rod engages a lock ring which is coupled to the housing by a pair of pins, the housing being provided with a circular set of holes permitting the neutral position of the handle to be rotated with respect to the housing.

U.S. Pat. No. 4,794,820, which issued to Floeter on Jan. 3, 1989, discloses a marine drive twin lever remote control with interlock override. The actuator operates push-pull cables and has two sets of pulleys on opposite sides of a control body. An interlock structure normally prevents movement of the shift lever and its cable when the throttle lever and its cable are in a high speed position and with the operator applying normal force to the shift lever. An override structure permits movement of the shift lever and its cable with the throttle lever in a high speed position when the operator applies an abnormally high force to the shift lever, to enable emergency high speed shifting including from forward to reverse, to facilitate rapid deceleration.

The patents described above are hereby expressly incorporated by reference in the description of the present invention.

Those skilled in the art of marine vessels and marine propulsion systems are well acquainted with many types of remote control throttle and shift mechanisms. Typically, a manually movable control handle is used to perform the dual functions of selecting a gear position among forward, neutral, and reverse alternatives, and also to select a throttle position which controls the operating speed of the marine engine. In many applications, an initial movement of the throttle handle from the neutral midpoint first causes the gear selection to occur and then, in response to further movement of the handle, causes the throttle to increase the operating speed of the engine. During the movement of the handle from a central neutral position to a gear selection position, the operator produces sufficient force to cause the actual transmission of the engine to shift from neutral to either a forward or reverse position. This force can be communicated from the handle to the actual transmission through the use of a push-pull cable or other means. Within the force transmitting mechanism, gear teeth can be used to transmit the force from the handle to a mechanism which, in turn, causes a push-pull cable or other device to activate the actual gear selection at the marine propulsion system. The force can be translated through the use of gears, as discussed above, or through the use of mechanical linkages which can comprise a lever/fulcrum arrangement.

It would be significantly beneficial if the required force by the operator on the control handle can be reduced in order to make the shifting effort easier.

SUMMARY OF THE INVENTION

A throttle control mechanism made in accordance with the preferred embodiment of the present invention comprises a support structure which is attachable to a marine vessel. The support structure typically comprises a housing within which the appropriate linkages and/or gear devices are contained. The mechanism further comprises a handle which is rotatably attached to the support structure for rotation about a rotational axis between a first maximum limit in a first direction and a second maximum limit in a second direction. An angular range of travel of the handle between the first and second maximum limits comprises a neutral gear zone which is disposed between a forward gear zone and a reverse gear zone. A first portion of the angular range of travel is located between a midpoint of the neutral gear one and the first maximum limit in the first direction. A second portion of the angular range of travel is located between the midpoint of the neutral gear zone and the second maximum limit in the second direction. The first portion of the angular range of travel comprises a greater magnitude of angular travel than the second portion of the angular range of travel.

The forward gear zone comprises a greater magnitude of angular travel than the reverse gear zone in a particularly preferred embodiment of the present invention. The handle comprises a first end and a second end. The first end is rotatably attachable to the support structure and the second end is a distal end of the handle. The handle comprises a first section and a second section. The first and second sections are joined to each other to form an angle therebetween.

A reference axis is defined between a first position of the second end of the handle at the first maximum limit in the first direction and a second position of the second end of the handle at the second maximum limit in the second direction. The second section of the handle being generally perpendicular to the reference axis when the handle is disposed at the midpoint at the neutral gear zone. The first maximum limit in the first direction of travel of the handle is coincident with a maximum forward speed position of the handle within the forward gear zone in a preferred embodiment of the present invention. Similarly, the second maximum limit in the second direction is coincident with a maximum reverse speed position of the handle within the reverse gear zone.

The first and second sections of the handle are generally linear in a preferred embodiment of the present invention. The forward gear zone is disposed within the first portion of the angular range of travel and the reverse gear zone is disposed within the second portion of the angular range of travel. The neutral gear zone comprises a greater magnitude of angular travel than the forward gear zone. The forward gear zone comprises generally between 50 and 70 degrees in total angular travel in a preferred embodiment of the present invention and the neutral gear zones comprises generally between 80 and 100 degrees in total angular travel. The present invention, in a particularly preferred embodiment, comprises a forward gear zone that is approximately 60 degrees in total angular travel and a neutral gear zone that is approximately 90 degrees in total angular travel.

BRIEF DESCRIPTION OF THE DRAWINGS

The present invention will be more fully and completely understood from a reading of the description of the preferred embodiment, in conjunction with the drawings, in which.

DESCRIPTION OF THE PREFERRED EMBODIMENT

Figure 1:
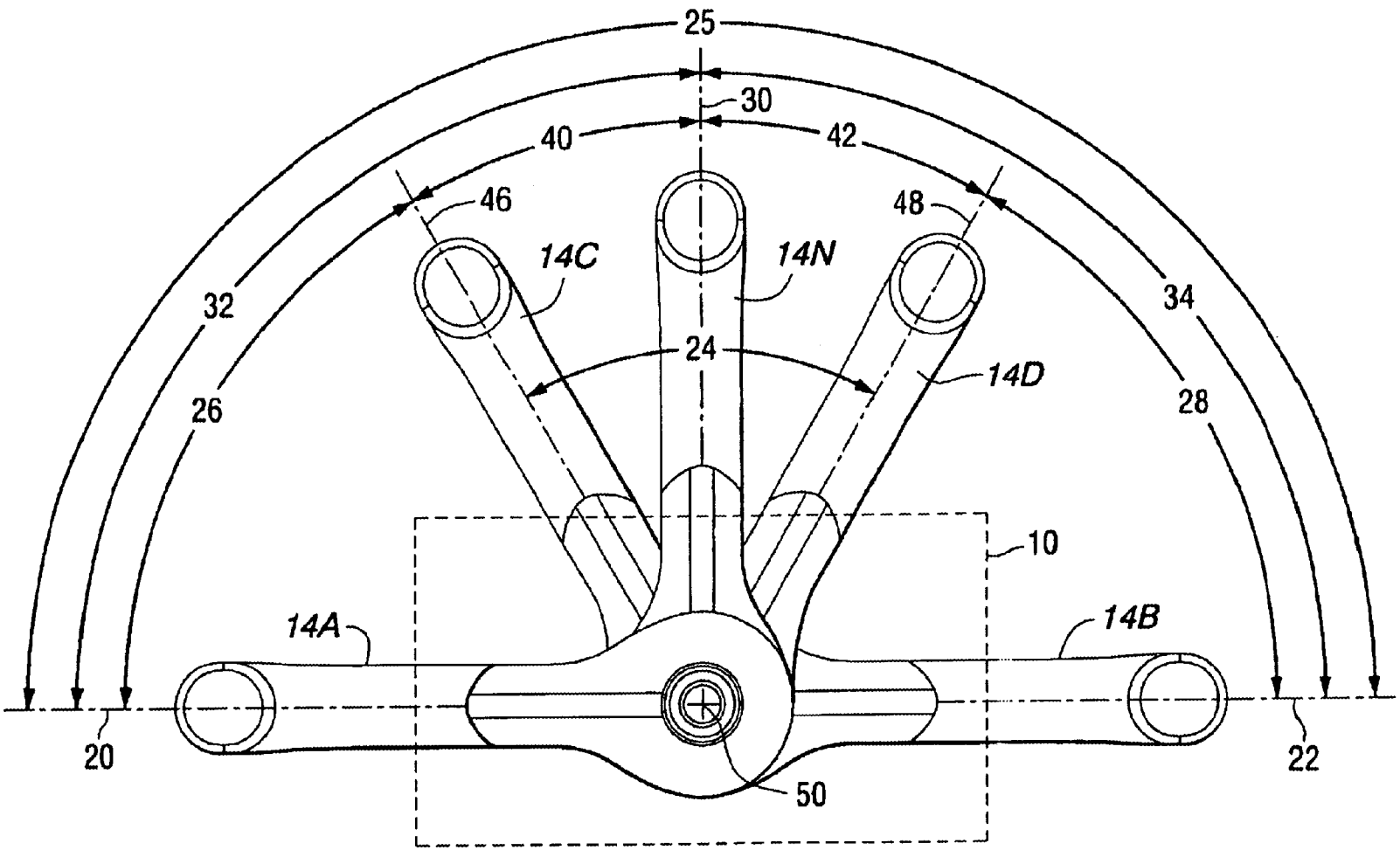
FIG. 1 PRIOR ART
FIG. 1 shows various alternative positions of a manually controllable handle known to those skilled in the art.

Throughout the description of the preferred embodiment of the present invention, like components will be identified by like reference numerals.

FIG. 1 shows a typical arrangement of a support structure 10 and a handle that is rotatably attached to it. The single handle 14 is shown in 5 alternative positions (i.e. 14A, 14B, 14C, 14D, 14N) in FIG. 1. It should be understood that in most applications of a remote control throttle and gear controlling mechanism, a single handle is used in conjunction with a single support structure. The illustration of FIG. 1 will be used to describe various terms relating to the position and movement of the handle 14 in relation to the support structure 10.

Line 20 represents a first maximum limit of travel in a first direction (i.e. counterclockwise) of the handle 14. In this position, the handle is identified as 14A and it shows the handle in position at the first maximum limit 20 of travel in a first direction, which is counterclockwise in FIG. 1. The handle 14 also has a second maximum limit 22 of travel in a second direction, which is clockwise in FIG. 1. The handle is identified as 14B when in this position in FIG. 1. The total angular range of travel of the handle 14 between the first and second maximum limits, 20 and 22, comprises a neutral gear zone, identified by arrow 24, which is disposed between a forward gear zone identified by arrow 26 and a reverse gear zone identified by arrow 28. A midpoint 30 of the neutral gear zone 26 is identified in FIG. 1. A first portion 32 of the angular range of travel 25 is located between the midpoint 30 of the neutral gear zone 24 and the first maximum limit 20 of travel in the first direction. A second portion 34 of the angular range of travel 25 is located between the midpoint 30 of the neutral gear zone 24 and the second maximum limit 22 of travel in the second direction. The first portion 32 of the angular range of travel 25, in a system known to those skilled in the art as illustrated in FIG. 1, is generally equal to the second portion 34. However, as will be described in greater detail below, in a preferred embodiment of the present invention, the first portion 32 is greater in magnitude of angular travel than the second portion 34.

With continued reference to FIG. 1, two other ranges of travel are identified by arrows. Arrow 40 represents the angular travel of the handle 14 as it moves from the midpoint 30 to a position, represented by line 46, where the transmission is caused to shift from a neutral gear position to a forward gear position. Similarly, the angular travel identified by arrow 42 represents the distance of travel of the handle 14 between the midpoint 30 and a position 48 at which the transmission is caused to shift from neutral to reverse gear. The handle is identified by reference numeral 14C when at the shifting location 46 between the neutral gear and the forward gear position. Similarly, the handle is identified by reference numeral 14D when in the shifting position 48 between a neutral gear position and a reverse gear position.

When at the midpoint of the neutral gear zone, the handle is identified by reference numeral 14N.

With continued reference to FIG. 1, it can be seen that a remote control gear and throttle mechanism is typically symmetrical about the midpoint 30. As is the handle rotates about its axis of rotation 50, the travel through the neutral gear zone 24 in either direction from the midpoint 30 is generally equal to the travel in the opposite direction. Similarly, the forward gear zone 26 represents approximately an equal range of travel when compared to the reverse gear zone 28. In known systems, angular range 26 is approximately 60 degrees, angular ranges 40 and 42 are approximately 30 degrees each, and angular range 28 is approximately 60 degrees. The total angular range 25 is approximately 180 degrees.

Figure 2:
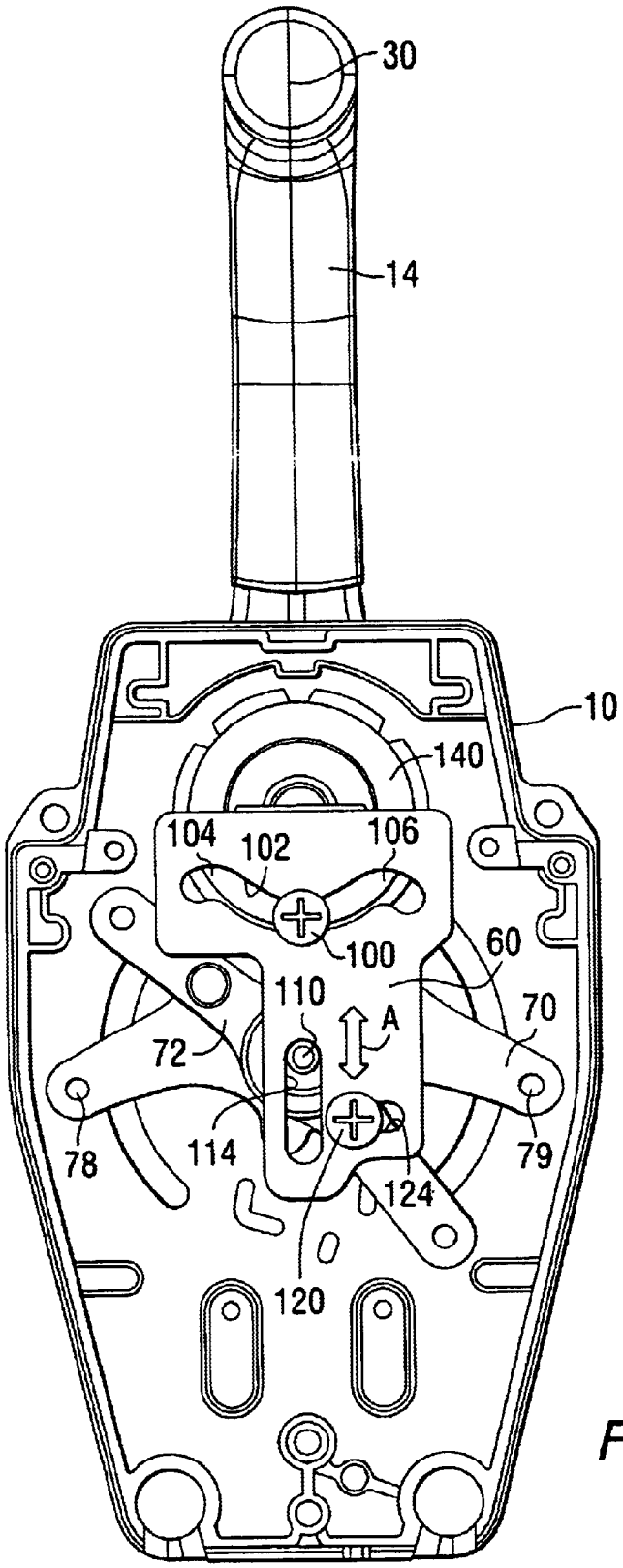
FIG. 2 shows a support structure and internal mechanism of a remote control throttle and gear position handle made in accordance with a preferred embodiment of the present invention.
Figure 3:
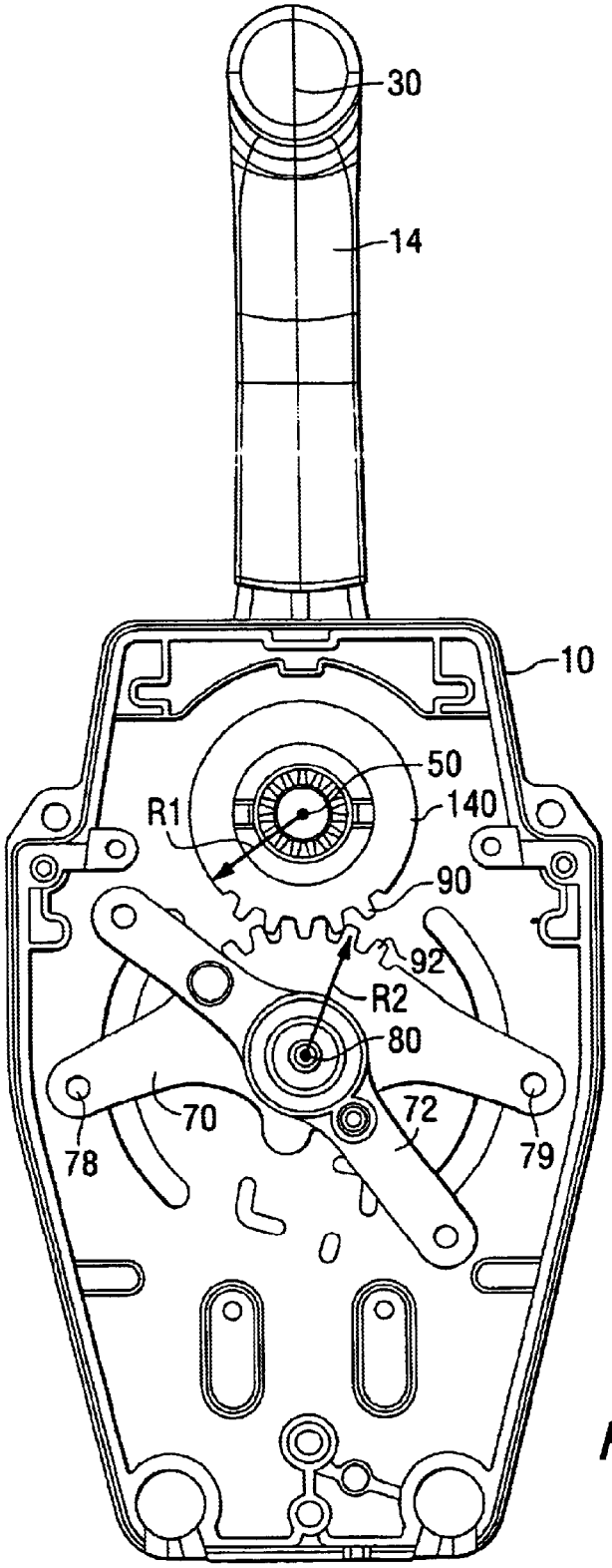
FIG. 3 is similar to FIG. 2, but with certain components removed to improve the clarity of the illustration.

FIGS. 2 and 3 illustrate the mechanism of the throttle control device, particularly the components within the support structure 10. The handle 14 is shown extending upwardly from the support structure in a way that allows it to rotate about the axis of rotation 50. It should be understood that movement of the handle 14 about the axis of rotation 50 has two important effects on the operation of a marine propulsion system. The first portion of travel in either direction from the midpoint 30 causes the transmission to move from the neutral gear position to either the forward or reverse gear positions depending on the direction of travel of the handle 14. Continued rotation of the handle 14 causes the engine speed to increase by controlling the throttle of the engine.

With continued reference to FIGS. 2 and 3, it can be seen that FIG. 3 is generally identical to FIG. 2 except that the plate 60 is removed in FIG. 3 for purposes of allowing the internal mechanism to be more visible. Two lever mechanisms are utilized to control the transmission and the throttle of the engine. A first lever mechanism 70 controls the gear selection. A second lever mechanism 72 controls the throttle which, in turn, controls the operating speed of the engine.

The basic structure shown in FIGS. 2 and 3 is generally known to those skilled in the art and has been used in remote control throttle and gear selection mechanisms in the past.

With reference to lever mechanism 70, the holes, 78 and 79, are attachable to the ends of a push-pull cable so that rotation of the gear control lever mechanism 70 about axis 80 causes the gear selection to change at the engine. In a typical application, only one of the holes, 78 or 79, is used for this purpose. The other hole, 78 or 79, allows the choice for the system to be connected in an opposite operating direction.

When the handle 14 is rotated about its axis 50 of rotation, the gear tooth meshing arrangement between gears 90 and 92 cause the gear control lever mechanism 70 to rotate about its axis 80. As is well understood by those skilled in the art, the effective radii of the two sets of gear teeth, 90 and 92, determine the overall mechanical advantage of the system. In other words, the effective ratio of radii R1 and R2 determines the force relationship between a force imposed on the handle 14 by the operator of a marine vessel and the resulting force exerted on a push-pull cable connected to a selected one of the holes, 78 or 79. In addition, the arc lengths of the two gear toothed arrangements, 90 and 92, determine the relative angular rotation of the gear lever 70 in relation to the angular rotation of the handle 14 about its axis of rotation 50.

It should be understood that, although FIGS. 2 and 3 illustrate a preferred embodiment of the present invention, these two illustrations also show the basic arrangements of some of the components used in prior art versions of remote control mechanism. The advantages of the present invention, as will be described in greater detail below, relate to the relative ranges of travel of the handle 14 in relation to the gear lever 70.

With continued reference to FIGS. 2 and 3, the plate 60 serves a purpose that is not directly related to the operation of the present invention. As is generally understood by those skilled in the art, pin 100 rotates about axis 50 in response to rotation of the handle 14. Pin 100 travels in a curved slot 102 to have negligible is effect on the position of the plate 60 until pin 100 reaches the end portions, 104 or 106 of the curved slot 102. At that point, continued rotation of the handle 14 about its axis 50 causes the plate 70 to move upward or downward as represented by arrow A in FIG. 2. The movement of plate 60 is then controlled by the relationship of pin 110 in slot 114. This maintains the general vertical movement of the plate 60 as represented by arrow A. Pin 120 is movable in slot 124. Pin 120 is attached to lever mechanism 72 and, as a result, movement of plate 60 in an upward or downward direction causes lever mechanism 72 to rotate about the axis 80. Lever mechanism 72 controls the throttle operation and operating speed of the engine. The basic operation of lever mechanism 72 is not significantly altered by the inclusion of the concepts of the present invention in the mechanism shown in FIGS. 2 and 3.

Figure 5:
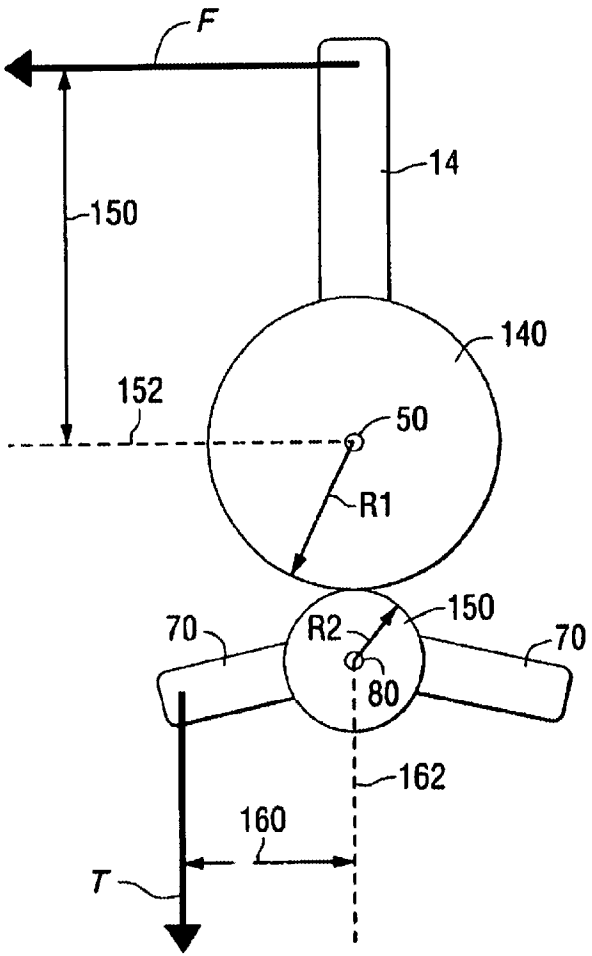
FIGS. 4 and 5 are highly simplified schematics to show the basic operating principle of the remote control mechanism.
Figure 4:
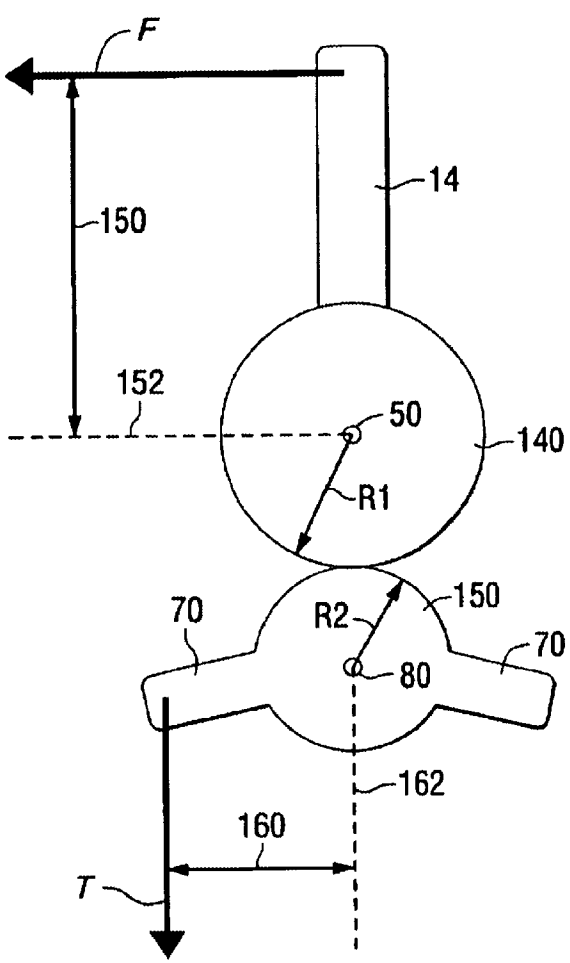

FIGS. 4 and 5 are highly schematic representations of the mechanism described above in conjunction with FIGS. 2 and 3.

In FIGS. 4 and 5, the circular member 140 and the central portion 150 of the gear control lever mechanism 70 are shown without the teeth (i.e. 90 and 92) being specifically illustrated. However, it should be understood that the interface between the components 140 and 150 is provided with a gear tooth meshing relationship between the sets of teeth, 90 and 92, as described above in conjunction with FIGS. 2 and 3.

With continued reference to FIGS. 4 and 5, several forces and dimensions are provided. A force vector F is identified in FIGS. 4 and 5 to represent the manually provided force on the handle 14. This force is provided at a distance 150 from a parallel line 152 through the central axis 50 of rotation of component 140. Arrow 150 represents the effective moment arm of force vector F. Similarly, a resulting force T is illustrated at a distance 160 from a line 162 taken through the central axis 80 about which component 150 rotates. Because of the gear mesh relationship of gears 90 and 92, described in conjunction with FIGS. 2 and 3, manually applied force F results in a resulting force T exerted on the push-pull cable. The relationship between forces F and T is determined by the relative magnitudes of radii R1 and R2. In FIG. 5, radii R1 and R2 are shown to be different in relative size than in FIG. 4. In other words, R1 in FIG. 4 is smaller than R1 in FIG. 5 and R2 in FIG. 4 is larger than R2 in FIG. 5. In FIG. 4, therefore, a greater rotation of the handle 14 is necessary, when compared to the arrangement in FIG. 5, to result in an identical degree of rotation of component 150 and, as a result, an identical movement of the push-pull cable attached to the lever 70. As R1 is made smaller, a greater angular magnitude of travel is required by handle 14 to achieve an identical range of travel of the lever mechanism 70. Conversely, although a greater range of travel is necessary by the handle 14, the required force F is correspondingly less to achieve an identical force T on the push-pull cable. In other words, if the gear radii, R1 and R2, are selected to require a greater angular travel by the handle 14, a reduction in the force F can be achieved in order to result in an identical force T on the push-pull cable. As a result, if a greater angular travel by the handle 14 is required, reduced force F will be necessary. The present invention is intended to provide the reduced force F necessary to achieve a specific force T by allowing for a greater range of travel within the shifting zone between the midpoint 30 and either the forward shift point 46 or the reverse shift point 48, as described above in conjunction with FIG. 1. In addition, the relative rotational positions of the gear lever 70 and component 140, when the handle 14 is at various rotational positions, can be set so that the zones described above in conjunction with FIG. 1 are asymmetrical about a midpoint 30 and sized to achieve the mechanical advantage described above.

Figure 6:
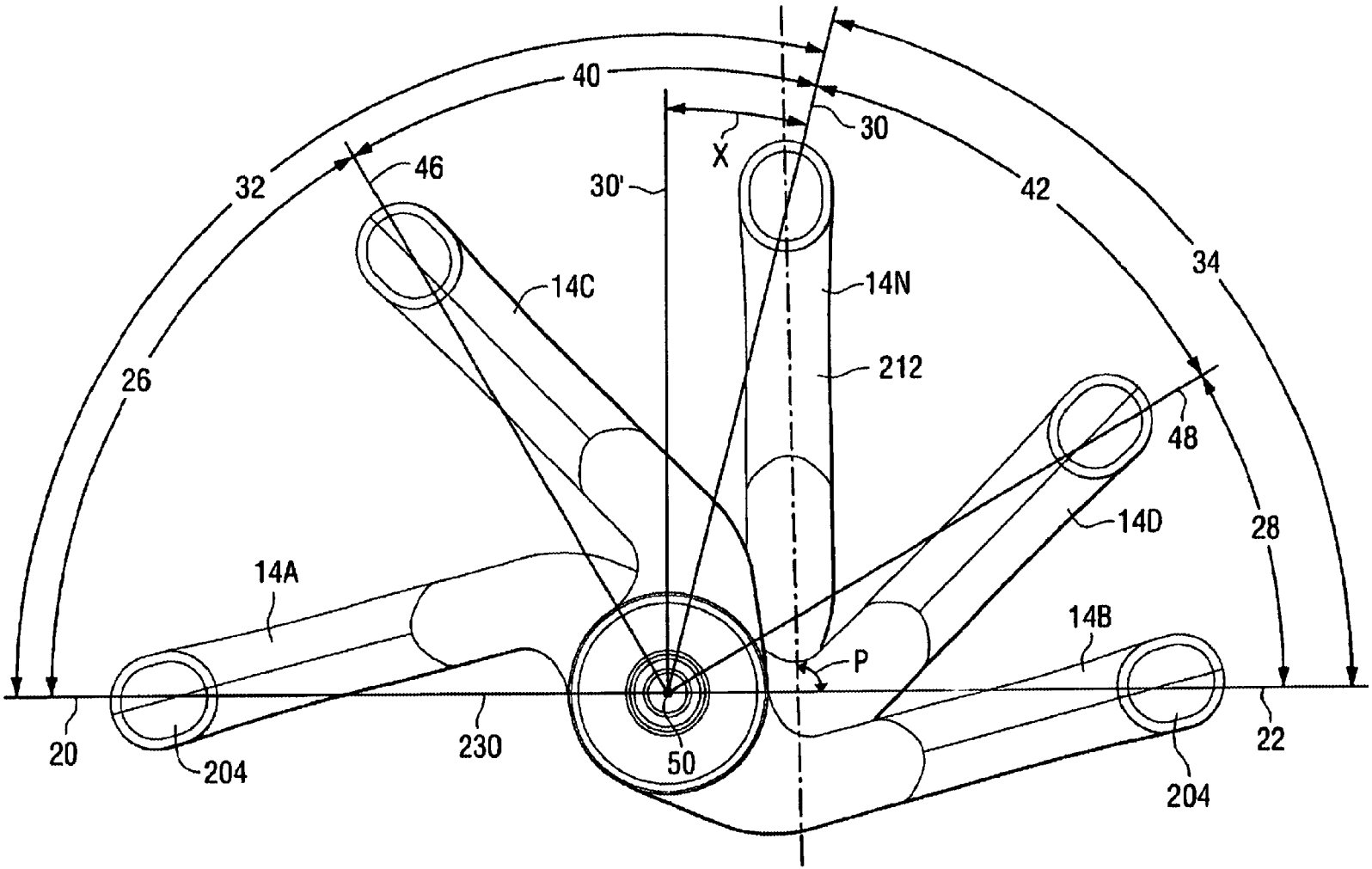
FIG. 6 shows the handle movement of a remote control mechanism made in accordance with a preferred embodiment of the present invention.

FIG. 6 illustrates the operation made possible by the present invention which, in turn, is made possible by changing the radii, R1 and R2, described above in conjunction with FIGS. 4 and 5 to alter the relationships between forces F and T. With reference to FIGS. 1 and 6, the present invention is illustrated in FIG. 6 and the prior art is illustrated in FIG. 1. Five alternative handle positions are shown in each illustration. As can be seen, the midpoint 30 in FIG. 6 is moved, as represented by arrow X, from its position shown in FIG. 1.

For purposes of understanding these relative changes, the midpoint 50 represented a line that was generally perpendicular to lines 20 and 22 in FIG. 1. In FIG. 6, the midpoint 30 of the present invention is shifted by an angular magnitude represented by arrow X. The first portion 32 of the present invention, as shown in FIG. 6, is significantly larger than the second portion 34. In FIG. 1, the first and second portions, 32 and 34, are generally equal to each other.

The neutral gear zone, which comprises arrows 40 and 42, is significantly larger in the present invention, as shown in FIG. 6, than in the prior art shown in FIG. 1. This means that the travel distance between the midpoint 30 and line 46, represented by arrow 40 is increased as a result of a decrease in the arc length of the gear teeth 90 relative to the arc length of the gear teeth 92, as described above in conjunction with FIG. 3.

The forward gear zone 26 is maintained generally equal in the present invention as compared to the prior art in order to facilitate accommodation with the range of travel of the throttle control mechanism of most standard engine configurations. The reverse gear zone 28 is significantly reduced in the present invention shown in FIG. 6 in order to allow for the enlargement of the neutral gear zone, which comprises arrows 40 and 42 in FIG. 6.

As a result of the present invention, as illustrated in FIG. 6, the increased travel represented by arrow 40 between the midpoint 30 and the shifting position is 46 from neutral gear position to forward gear position, decreases the force required by the operator to move the handle 14 from position 14N to 14C. Similarly, movement from position 14N to 14D is reduced accordingly.

In a particularly preferred embodiment of the present invention, the handle 14 is configured to result in it being positioned in a generally perpendicular attitude, represented by 14N in FIG. 6, in relation to a line comprising lines 20 and 22. This perpendicularity is represented by arrow P in FIG. 6. It should be understood that the five handle positions shown in FIG. 6 represent five alternative positions of a single handle 14 as described above.

Figure 7:
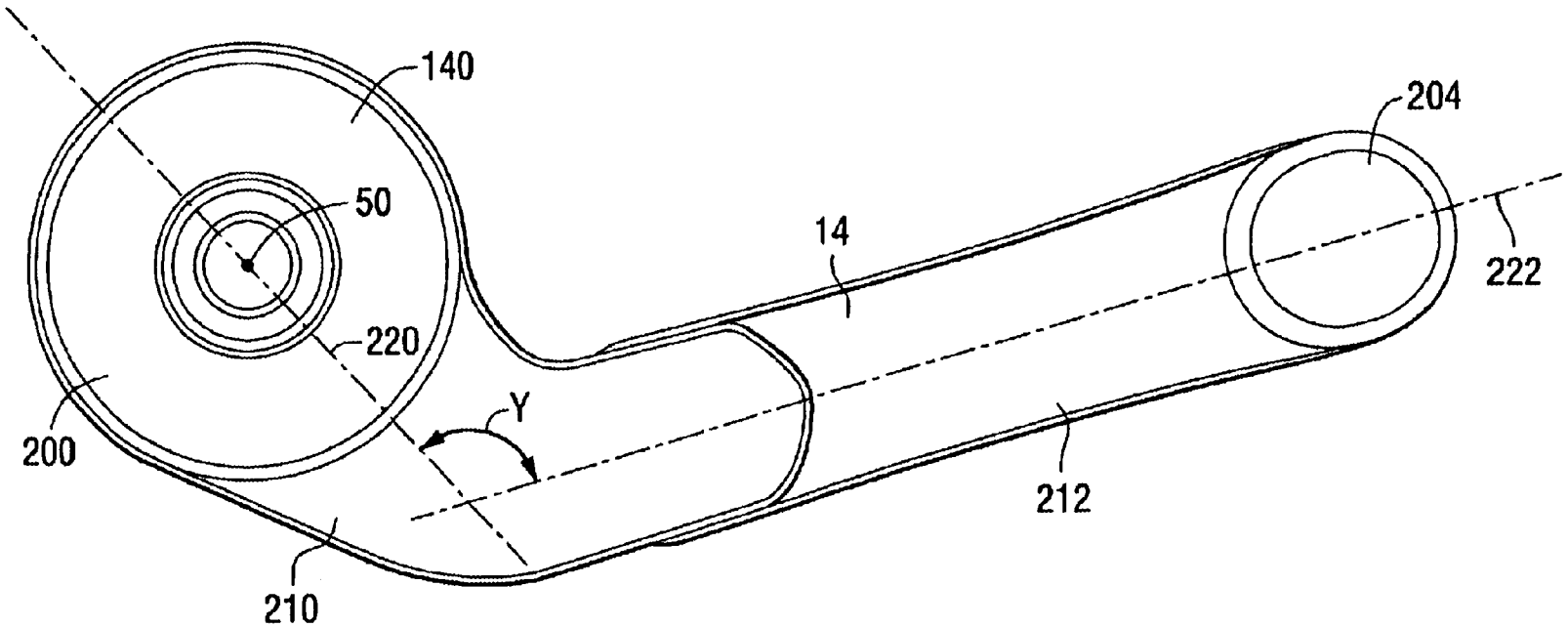
FIG. 7 shows a particularly preferred shape of a handle used in conjunction with the present invention.

FIG. 7 shows a handle 14 made in accordance with a particularly preferred embodiment of the present invention that allows the handle 14 to appear in a generally perpendicular relationship, as identified by angle P in FIG. 6, when the handle is at the midpoint even though the relative gear zones are asymmetrical in a preferred embodiment of the present invention. The handle 14 comprises a first end 200 and a second end 204. The first end 200, as described above, is rotatably attachable to the support structure 10 for rotation about a central axis 50. The second end 204 is a distal end of the handle 14. The handle comprises a first section 210 and a second section 212 which are aligned along their respective linear axes 220 and 222. The first and second sections, 210 and 212, are joined to each other to form an angle Y therebetween. In one embodiment of the present invention, angle Y is approximately 120 degrees, but many other options are possible within the scope of the present invention. In addition, although the first and second sections, 220 and 222, appear to be generally linear and are aligned along their axes 220 and 222, many different shapes of the handle 14 are possible within the scope of the present invention.

With reference to FIGS. 6 and 7, it can be seen that a reference axis 230 is defined between a first position of the second end 204 of the handle 14 at the first maximum limit 20 in the first direction (counterclockwise) and a second position of the second end 204 of the handle 14 at a second maximum limit 22 in the second direction (clockwise). The second section 212 of the handle 14 is generally perpendicular, as represented by angle P in FIG. 6, to the reference axis 230 when the handle 14 is disposed at the midpoint 30 of the neutral gear zone which is identified by angles 40 and 42.

The first maximum limit 20 in the first direction is coincident with a maximum forward speed position of the handle 14 within the forward gear zone 26. The second maximum limit 22 in the second direction is coincident with a maximum reverse speed position of the handle within the reverse gear zone 28. The first and second sections, 210 and 212, of the handle 14 are generally linear in shape in a preferred embodiment of the present invention. The forward gear zone 26 is disposed within the first portion 32 of the angular range of travel of the handle 14 and the reverse gear zone 28 is disposed within the second portion 34 of the angular range of travel of handle 14. The neutral gear zone, which includes the angular range identified by arrows 40 and 42, comprises a greater magnitude of angular travel than the forward gear zone 26 in a preferred embodiment of the present invention. The forward gear zone 26 comprises generally between 50 and 70 degrees in total angular travel in a preferred embodiment, such as that shown in FIG. 6. In a particularly preferred embodiment, the forward gear zone 26 comprises approximately 60 degrees in travel. The neutral gear zone, which comprises angular regions 40 and 42, comprises generally between 80 and 100 degrees in total angular travel and, in a particularly preferred embodiment, is generally equal to approximately 90 degrees.

Although the present invention has been described in particular detail and illustrated to show a preferred embodiment, it should be understood that alternative embodiments are also within its scope.

We claim:

1. A throttle control mechanism, comprising:

a support structure which is rigidly attachable to a marine vessel; and a handle rotatably attached to said support structure for rotation about a rotational axis between a first maximum limit in a first direction and a second maximum limit in a second direction, an angular range of travel of said handle between said first and second maximum limits comprising a neutral gear zone which is disposed between a forward gear zone and a reverse gear zone, a first portion of said angular range of travel being located between a midpoint of said neutral gear zone and said first maximum limit in said first direction, a second portion of said angular range of travel being located between said midpoint of said neutral gear zone and said second maximum limit in said second direction, said first portion of said angular range of travel comprising a greater magnitude of angular travel than said second portion of said angular range of travel.

2. The throttle mechanism of claim 1, wherein:

said forward gear zone comprises a greater magnitude of angular travel than said reverse gear zone.

3. The throttle mechanism of claim 1, wherein:

said handle comprises a first end and a second end, said first end being rotatably attachable to said support structure, said second end being a distal end of said handle, said handle comprising a first section and a second section, said first and second sections being joined to each other to form an angle therebetween.

4. The throttle mechanism of claim 3, wherein:

a reference axis is defined between a first position of said second end of said handle at said first maximum limit in said first direction and a second position of said second end of said handle at said second maximum limit in said second direction, said second section of said handle being generally perpendicular to said reference axis when said handle is disposed at said midpoint of said neutral gear zone.

5. The throttle mechanism of claim 1, wherein:

said first maximum limit in said first direction is coincident with a maximum forward speed position of said handle within said forward gear zone.

6. The throttle mechanism of claim 1, wherein:

said second maximum limit in said second direction is coincident with a maximum reverse speed position of said handle within said reverse gear zone.

7. The throttle mechanism of claim 3, wherein:

said first and second sections are both generally linear.

8. The throttle mechanism of claim 1, wherein:

said forward gear zone is disposed within said first portion of said angular range of travel and said reverse gear zone is disposed within said second portion of said angular range of travel.

9. The throttle mechanism of claim 1, wherein:

said neutral gear zone comprises a greater magnitude of angular travel than said forward gear zone.

10. The throttle mechanism of claim 1, wherein:

said forward gear zone comprises generally between fifty and seventy degrees in total angular travel and said neutral gear zone comprises generally between eighty and one hundred degrees in total angular travel.

11. A throttle control mechanism, comprising:

a support structure which is rigidly attachable to a marine vessel; and a handle rotatably attached to said support structure for rotation about a rotational axis between a first maximum limit in a first direction and a second maximum limit in a second direction, an angular range of travel of said handle between said first and second maximum limits comprising a neutral gear zone which is disposed between a forward gear zone and a reverse gear zone, said forward gear zone comprising a greater magnitude of angular travel than said reverse gear zone, said first maximum limit in said first direction being coincident with a maximum forward speed position of said handle within said forward gear zone, said second maximum limit in said second direction being coincident with a maximum reverse speed position of said handle within said reverse gear zone, said neutral gear zone comprising a greater magnitude of angular travel than said forward gear zone.

12. The mechanism of claim 11, wherein:

a first portion of said angular range of travel is located between a midpoint of said neutral gear zone and said first maximum limit in said first direction, a second portion of said angular range of travel being located between said midpoint of said neutral gear zone and said second maximum limit in said second direction, said first portion of said angular range of travel comprising a greater magnitude of angular travel than said second portion of said angular range of travel.

13. The throttle mechanism of claim 12, wherein:

said handle comprises a first end and a second end, said first end being rotatably attachable to said support structure, said second end being a distal end of said handle, said handle comprising a first section and a second section, said first and second sections being joined to each other to form an angle therebetween.

14. The throttle mechanism of claim 13, wherein:

a reference axis is defined between a first position of said second end of said handle at said first maximum limit in said first direction and a second position of said second end of said handle at said second maximum limit in said second direction, said second section of said handle being generally perpendicular to said reference axis when said handle is disposed at said midpoint of said neutral gear zone.

15. The throttle mechanism of claim 14, wherein:

said first and second sections are both generally linear.

16. The throttle mechanism of claim 15, wherein:

said forward gear zone is disposed within said first portion of said angular range of travel and said reverse gear zone is disposed within said second portion of said angular range of travel.

17. The throttle mechanism of claim 16, wherein:

said forward gear zone comprises generally between fifty and seventy degrees in total angular travel and said neutral gear zone comprises generally between eighty and one hundred degrees in total angular travel.

18. A throttle control mechanism, comprising:

a support structure which is rigidly attachable to a marine vessel; and a handle rotatably attached to said support structure for rotation about a rotational axis between a first maximum limit in a first direction and a second maximum limit in a second direction, an angular range of travel of said handle between said first and second maximum limits comprising a neutral gear zone which is disposed between a forward gear zone and a reverse gear zone, said forward gear zone comprising a greater magnitude of angular travel than said reverse gear zone, said first maximum limit in said first direction being coincident with a maximum forward speed position of said handle within said forward gear zone, said second maximum limit in said second direction being coincident with a maximum reverse speed position of said handle within said reverse gear zone, said neutral gear zone comprising a greater magnitude of angular travel than said forward gear zone, said handle comprising a first end and a second end, said first end being rotatably attachable to said support structure, said second end being a distal end of said handle, said handle comprising a first section and a second section, said first and second sections being joined to each other to form an angle therebetween.

19. The mechanism of claim 18, wherein:

a first portion of said angular range of travel is located between a midpoint of said neutral gear zone and said first maximum limit in said first direction, a second portion of said angular range of travel being located between said midpoint of said neutral gear zone and said second maximum limit in said second direction, said first portion of said angular range of travel comprising a greater magnitude of angular travel than said second portion of said angular range of travel.

20. The throttle mechanism of claim 19, wherein:

a reference axis is defined between a first position of said second end of said handle at said first maximum limit in said first direction and a second position of said second end of said handle at said second maximum limit in said second direction, said second section of said handle being generally perpendicular to said reference axis when said handle is disposed at said midpoint of said neutral gear zone, said first and second sections being both generally linear.

* * * * *